United States Patent [19]

Schneiter

[11] 4,253,174

[45] Feb. 24, 1981

[54] ELECTRONIC TIMEPIECE

[75] Inventor: Ali Schneiter, Neuchatel, Switzerland

[73] Assignee: Ebauches S.A., Switzerland

[21] Appl. No.: 127,645

[22] Filed: Mar. 6, 1980

[30] Foreign Application Priority Data

Apr. 4, 1979 [CH] Switzerland ..... 3143/79

[51] Int. Cl.[3] ..... G04B 19/04; G04C 9/00

[52] U.S. Cl. ..... 368/80; 368/187

[58] Field of Search ..... 368/69, 76, 80, 155, 368/156, 157, 184, 185, 187–189; 318/696, 685, 341

[56] References Cited

U.S. PATENT DOCUMENTS

| | | | |
|---|---|---|---|
| 3,655,698 | 5/1972 | Dome | 368/185 |
| 4,031,448 | 6/1977 | Adachi | 318/696 |
| 4,037,402 | 7/1977 | Sieber | 368/189 |

*Primary Examiner*—Vit W. Miska

*Attorney, Agent, or Firm*—Allegretti, Newitt, Witcoff & McAndrews

[57] ABSTRACT

A time resetting operation in an electronic timepiece requires blocking of the stepping motor 1, and block of the mechanical type is avoided by the invention. A STOP switch 10 actuated by a time resetting stem of the timepiece sets to state "1" a flip-flop 11 which blocks gates 12 and 13 for controlling the passage of the pulses which drive the motor 1 through a feed circuit 2. The circuit 2 then passes a continuous current in the same direction as the last drive pulse. Thus, triggering of the continuous current leaves the position of the rotor unchanged. A counter 14 counts 1-second pulses and then resets the flip-flop 11, which causes the motor to resume normal operation. This avoids excessive discharging of the battery of the electronic timepiece if the user forgets to return the stem to its initial position after a time resetting operation.

3 Claims, 2 Drawing Figures

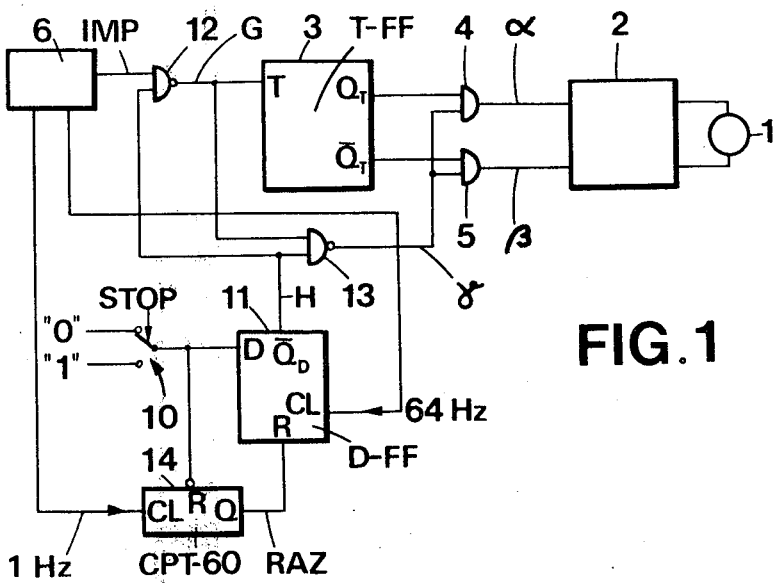
FIG. 1
FIG. 2
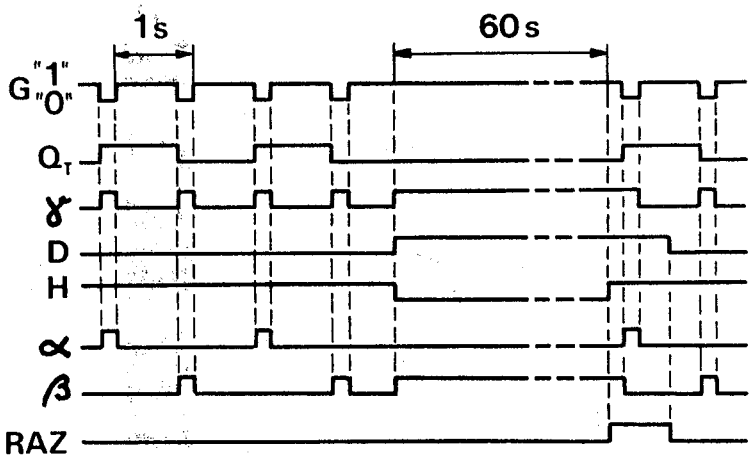

ELECTRONIC TIMEPIECE

BACKGROUND OF THE INVENTION

The invention concerns an electronic timepiece, which may in a particular embodiment be a watch, comprising a time base circuit, a steeping motor actuated by pulses supplied by the time base circuit, display means driven by the stepping motor, and mechanical time resetting means commonly actuated by a member of the rewinding stem type.

The stepping motor of a watch of the above-indicated type must be blocked when a time resetting operation is to be effected. Published Swiss application No. 14, 203/70 discloses an electronic timepiece in which the blocking action is entirely mechanical. Such a solution complicates the arrangement of the stepping motor which must be provided with a cam arranged to cooperate with a projection, and it complicates the mechanical part of the watch, by virtue of the presence of the projection.

BRIEF SUMMARY OF THE INVENTION

The present invention seeks to provide a simpler solution with regard to blocking the motor during a time resetting operation, avoiding the disadvantage of a blocking arrangement of mechanical type.

For this purpose, the present invention provides an electronic timepiece comprising a time piece, a stepping motor actuated by pulses supplied by the time base, display means driven by the stepping motor, mechanical time resetting means, and a blocking circuit which is responsive to actuation of the time resetting means to pass a continuous current into a coil of the motor so as to block the motor electrically during the time setting operation.

Should the user forgot to push the time setting stem back (assuming this type of resetting means), the continuous blocking current could cause excessive discharging of the battery. In order to avoid this disadvantage, the timepiece preferably comprises a time-delay circuit which acts on the blocking means to limit the period for which the continuous current flows to a period of time starting from actuation of the time resetting means.

BRIEF DESCRIPTION OF THE DRAWINGS

The invention will be described in more detail by way of example, with reference to the accompanying drawings, in which:

FIG. 1 shows an illustrative embodiment in accordance with the invention of a circuit for controlling the functions of a stepping motor; and FIG. 2 is a time graph illustrating the mode of operation of the circuit of FIG. 1.

DETAILED DESCRIPTION OF THE PREFERRED EMBODIMENT

The stepping motor 1 is controlled by a supply circuit 2, of a type well known in the art, comprising two pairs of C-MOS transistors. The inputs of the circuits 2 receive pulses $\chi$ and $\phi$ (one single pulse per 180° step in rotation of the motor) alternately depending on the position of the rotor of the motor.

The pulses $\chi$ and $\phi$ are formed from a signal Y, by means of two AND-gates 4 and 5 which are controlled by the outputs $Q_T$ and $\overline{Q}_T$ of a flip-flop 3 of the T type. The input T of the flip-flop 3 receives pulses G which are inverted by a NAND gate 12 from pulses IMP having a period of one second and a duration for example of 7.8 ms. The pulses IMP are supplied by a time base 6.

In order to provide for blocking of the motor, the circuit comprises two NAND-gates 12 and 13 which are controlled by a flip-flop 11 of the D type, and a stop switch 10 which is actuated when a time resetting operation is to be carried out, for example by pulling a stem similar to a rewinding stem. The switch 10 sets the input D of the flip-flop 11 to the logic state "1". The flip-flop 11 has a clock input CL receiving 64 Hz clock pulses which can be easily derived from the time base. In response to the input D being set to logic state "1", the output $\overline{Q}_D$ passes to the logic state "0" on the following clock pulse, which causes the gates 12 and 13 to be stopped at "1". Thereafter, the signal G is held at "1", so that the flip-flop 3 remains in the same state and holds in an active condition that one of the gates 4 and 5 which it had activated last. In addition, the signal $\alpha$ is also stopped at state "1" so that that one of the two signals $\alpha,\beta$ which has last been delivered is held at state "1". The effect of this is that the supply circuit 2 passes into the motor 1 a continuous current in the same direction as the direction of the last drive pulse. The advantage of this arrangement is that triggering and termination of the continuous current leave the position of the rotor unchanged.

In order to limit the period of time for which the continuous current flows, the circuit in FIG. 1 further comprises time-delay means including a counter 14 which counts in 60's. At its input CL, the counter receives 1 Hz clock pulses which are easily derived from the time base.

The counter 14 comprises a zero resetting input R which is controlled by the STOP switch 10 and an output Z which applies a signal RAZ (zero resetting) to the input R of the flip-flop 11. The counter 14 counts the pulses at a frequency of 1 Hz as soon as its zero resetting input R is set to state "1" by actuation of the STOP switch 10. When counter 14 has counted 60 seconds, its output Q and therefore the signal RAZ are stopped at state "1" as long as its input R is held at state "1". Under the effect of the signal RAZ which is applied to its input R, the flip-flop 11 then returns to zero, which puts its input $\overline{Q}_D$ at state "1" and therefore puts the signal H also at "1"; accordingly, the outputs of the gates 12 and 13 again transmit the pulses coming from the time base 6.

The counter 14 therefore permits the continuous current in the motor to be suppressed after a period of 60 seconds, and permits the motor to resume normal operation, even if the STOP switch 10 has remained at state "1". This arrangement avoids the danger of excessive discharging of the battery of the watch in case the user forgot to push the stem back after a time resetting operation.

In order to prevent the motor from resuming normal operation at the time of the period of 60 seconds, the output Q of the counter 14 may be connected to a supplementary input (not shown) of each of the gates 4, 5 and 12 by way of an inverter (not shown). These gates are then blocked as long as the output of the counter 14 remains at state "1", which prevents the pulses $\chi$ and $\phi$ from being formed. In this way, when the user sees that the seconds hand has stopped, he realizes that he has forgotten to push back the stem of his watch. Without this precaution, there would be the danger that the user would rely on a wrong time display.

Various modifications may be made in the form of the invention without departing from the spirit and principles of the invention as disclosed in the foregoing illustrative embodiment. It therefore is intended that the accompanying claims be construed as broadly as possible to cover various embodiments of the invention as is consistent with the prior art.

What is claimed is:

1. An electronic timepiece comprising a time base, a stepping motor actuated by pulses supplied by the time base, display means driven by the stepping motor, mechanical time resetting means, and a blocking circuit which is responsive to actuation of the time resetting means to apply continuous current to the motor so as to block the motor electrically during the time setting operation.

2. A timepiece according to claim 1, further comprising a time-delay circuit which is triggered by actuation of the time resetting means and which acts on the blocking circuit to limit the period of time for which the continuous current flows, to a period of time starting from actuation of the time resetting means.

3. A timepiece according to claim 1 or 2, wherein the blocking circuit is arranged to pass a continuous current of the same direction as the last pulse so that triggering and termination of the continuous current leave the position of the motor unchanged.

* * * * *